United States Patent [19]

Aoyama et al.

[11] 4,138,072

[45] Feb. 6, 1979

[54] METHOD AND APPARATUS FOR TREATING A YARN END OF A YARN PACKAGE

[75] Inventors: Hideki Aoyama; Kōichi Kawamoto, both of Matsuyama, Japan

[73] Assignee: Teijin Limited, Osaka, Japan

[21] Appl. No.: 834,996

[22] Filed: Sep. 20, 1977

[30] Foreign Application Priority Data

Mar. 25, 1977 [JP] Japan ..... 52-32048

[51] Int. Cl.[2] ..... B65H 67/00

[52] U.S. Cl. ..... 242/35.5 A; 242/18 EW; 242/41

[58] Field of Search ..... 242/35.5 A, 35.5 R, 242/18 R, 18 DD, 18 PW, 18 EW, 18 A, 41, 19; 57/52, 53

[56] References Cited

U.S. PATENT DOCUMENTS

| | | | |
|---|---|---|---|
| 1,718,629 | 6/1929 | Boyd | 242/18 EW X |
| 3,426,408 | 2/1969 | Wheelock | 242/18 R X |
| 3,921,922 | 11/1975 | Wust | 242/18 A |
| 3,964,723 | 6/1976 | Schippers et al. | 242/35.5 A |
| 3,999,715 | 12/1976 | Schippers et al. | 242/18 A |
| 4,007,882 | 2/1977 | Isoard | 242/35.5 A X |
| 4,023,743 | 5/1977 | Schippers | 242/35.5 A |
| 4,025,002 | 5/1977 | Sutton, III et al. | 242/18 EW X |
| 4,039,092 | 8/1977 | Schar | 242/35.5 A X |
| 4,041,686 | 8/1977 | Inaba et al. | 242/35.5 A X |
| 4,052,017 | 10/1977 | Schar | 242/35.5 A |

FOREIGN PATENT DOCUMENTS 1444044 7/1976 United Kingdom ..... 242/35.5 A

*Primary Examiner*—Stanley N. Gilreath
*Attorney, Agent, or Firm*—Kenyon & Kenyon et al.

[57] ABSTRACT

Disclosed is a method for treating a yarn end hanging down from a yarn package which is doffed by means of a doffing apparatus from the winding apparatus after completion of the package winding, and an apparatus for effecting the method.

The disclosed apparatus comprises a peg for receiving a doffed full package, a supporting member for rotatably supporting the peg, which peg including a securing member therein for securing a full bobbin held thereon, and a rotating member for rotating the peg with the full bobbin secured by the securing member to the peg, the rotating direction of the peg selected to be a direction which is the same as the rotational direction of the bobbin on the winding apparatus.

Utilizing this apparatus, a yarn end hanging down from the full bobbin can be wound back around the full bobbin.

Yarn end entanglement, full bobbin damages and damages of the doffing apparatus caused by the yarn end hanging down from the full bobbin can be prevented from occurring.

The disclosed apparatus, which is movable in front of the winding apparatus, can vertically displace the peg, swivel the peg within a horizontal plane and tilt the peg within a vertical plane.

19 Claims, 11 Drawing Figures

III
III
IV
IV
II
II
1
2
3
4
5
5a
7
8
9
10
11
12
13
14
15
16
20
21
22
23
24
27
28
30
30a
31
32
52
63
70
71
74
75
80
81
121
1a

METHOD AND APPARATUS FOR TREATING A YARN END OF A YARN PACKAGE

BRIEF DESCRIPTION OF THE INVENTION

This invention relates to a method for doffing a full bobbin, especially for treating a yarn end hanging down from a doffed yarn package, and to an apparatus for effecting the above-mentioned method. This invention relates especially to a method which is suitable for treating a yarn end hanging down from a yarn package comprising a yarn spun from a spinning apparatus and wound around a bobbin so that the yarn end is prevented from damaging (a) the package; (b) a doffing apparatus for doffing the full bobbin from a winding apparatus; and (c) a yarn package processing apparatus in a succeeding step. This invention is also related to an apparatus for carrying out the above-described method.

BACKGROUND OF THE INVENTION

In well-known methods, a yarn, especially a synthetic yarn spun from a melt spinning apparatus, is wound around a bobbin at a high speed by utilizing a winding apparatus such as that described in Japanese Laid-open Publication No. 5219/72 or in Japanese Laid-open Publication No. 60745/76.

In the winding apparatus described in Japanese Laid-open Publication No. 5219/72, when the amount of yarn wound around the bobbin reaches a predetermined quantity, the yarn running toward the full bobbin is cut by way of a yarn cutting device which is manually operated or which is mounted on a mechanically-operated doffing apparatus. Furthermore, the cut yarn end is sucked by a sucking device which is manually operated or which is mounted on the mechanically-operated doffing apparatus. Then the full bobbin is brought to a standstill after a high degree of deceleration. Thereafter, the full bobbin is doffed from the winding apparatus by way of the doffing apparatus. After a new empty bobbin is held by the winding apparatus, the sucked yarn is threaded onto the empty bobbin by hand or by way of the doffing apparatus. Thereafter, the threaded yarn is wound around the empty bobbin.

In the winding apparatus described in Japanese Laid-open Publication No. 60745/76, when the amount of yarn wound around the bobbin reaches a predetermined quantity, a turret for rotatably holding the bobbins is turned, the full bobbin is automatically replaced by an empty bobbin, the running yarn is automatically caught in a peripheral groove formed on the bobbin surface, and the yarn extending between the full bobbin and the empty bobbin is broken by the increased yarn tension. As a result, the yarn is successively wound around a bobbin without causing any stoppage thereof, and the full bobbin is doffed by way of a doffing apparatus.

In both cases, after a full bobbin is obtained, the full bobbin is doffed from the winding apparatus to a bobbin receiving apparatus of the doffing apparatus, which is of a type described in Japanese Patent Publication No. 11490/75, by way of a bobbin push-out device which is of a type described in Japanese Laid-open Publication No. 42867/76.

Since it is necessary to wind a regular-quality yarn around a bobbin during the whole winding operation, the yarn is advanced at a constant high speed and then wound around a bobbin at a high rotating speed, when a running yarn is cut after completion of package winding (in the winding apparatus described in Japanese Laid-open Publication No. 5219/72) or when a full bobbin is replaced by an empty bobbin after completion of a package winding (in the winding apparatus described in Japanese Laid-open Publication No. 60745/76). As a result, when the running yarn is cut, a yarn end extending from a full bobbin is rotated outwardly due to the centrifugal force created by the rotation of the full bobbin, and then the yarn is unwound from the full bobbin. Furthermore, in a winding apparatus, especially in a winding apparatus described in Japanese Laid-open Publication No. 5219/72, the full bobbin is decelerated rapidly, after the yarn running toward the full bobbin is cut and sucked by a sucking device, for decreasing the time required to replace the full bobbin with an empty bobbin and to restart the yarn winding around the empty bobbin, and for decreasing the amount of waste yarn sucked into the sucking device. Due to the reaction force of the above-mentioned rapid deceleration of the full bobbin, the yarn end is exposed to a tremendous force which causes the full bobbin to unwind. Accordingly, a long yarn end extends and hangs down from the full bobbin when the full bobbin is stopped. The length of yarn end may vary in accordance with the prevailing winding factors such as the quality and quantity of the oiling agent applied to the yarn, the winding speed of or the air flow around the winding apparatus. Sometimes, the yarn length may be equal to or more than 2M.

The above-mentioned long yarn end hanging down from the full bobbin causes various problems as described hereinafter.

The yarn end may entangle complicatedly around members of a doffing apparatus, such as a yarn cutting device or a yarn threading-up device. Accordingly, members mounted on the doffing apparatus may be damaged and cause problems in the operations of the doffing apparatus.

A transfer tail wind is usually formed on a bobbin at a position adjacent to a normally wound yarn package for facilitating the tail transfer operation in the succeeding yarn treating process. The above-mentioned yarn end may damage the transfer tail and decrease the commercial value of the yarn package.

While the doffed full bobbin, which is mounted on a package truck, is being transferred to a succeeding yarn treating process, such as a yarn-drawing process or a yarn package packing process, the yarn end may entangle around a transferring apparatus or around an apparatus situated at a position adjacent to the transferring path of the yarn package. In such cases, the apparatus and the yarn package may be damaged.

In addition, the yarn end may disturb the creel operation or the packing operation of the yarn package in the succeeding process, or the yarn end may often entangle around the creel apparatus or the packing apparatus.

However, no method for preventing the occurrence of yarn end hanging down from the full bobbin has been discovered yet.

SUMMARY OF THE INVENTION

The principal object of the present invention is to provide a method and an apparatus by which a yarn end hanging down from a full bobbin wound by means of a winding apparatus is treated easily and successfully and by which the above-mentioned problems can be solved.

According to this method and apparatus, yarn end entanglements, full bobbin damages and damages of the doffing apparatus caused by the yarn end hanging down from the full bobbin can be prevented from occurring.

Another object of the present invention is to provide a method and an apparatus by which the position of a receiving peg mounted on an apparatus for receiving a full bobbin from a winding apparatus can be varied in accordance with the height of a bobbin holder mounted on the winding apparatus or with the height of a peg mounted on a package truck. The method and the apparatus of the present invention can help to facilitate the treatment of the yarn end hanging down from a full bobbin doffed from a vertically multistaged winding apparatus or transferred to a package truck, the peg of which has a height different from that of the receiving peg mounted on the receiving apparatus.

A further object of the present invention is to provide an apparatus wherein a receiving peg mounted on a receiving apparatus can be swivelled around a vertical axis in accordance with a predetermined angle. Utilizing this apparatus, a full bobbin doffed from a bobbin holder (mounted on a winding apparatus) to a receiving peg (mounted on a receiving apparatus) can be transferred easily to a peg (mounted on a package truck or on a winding apparatus) for storage thereon for a while.

A still further object of the present invention is to provide an apparatus wherein a receiving peg mounted on a receiving apparatus can be tilted within a vertical plane. Utilizing this apparatus, a full bobbin doffed from a bobbin holder mounted on a winding apparatus to a receiving peg mounted on a receiving apparatus can be easily transferred to an upwardly inclined peg mounted on a package truck or projecting from a position located beneath the bobbin holder.

Another object of the present invention is to provide an apparatus wherein a receiving peg is frictionally engaged with a full bobbin mounted thereon for ensuring the rotation of the full bobbin around the axis of the receiving peg. Utilizing this apparatus, the full bobbin can wind the yarn end therearound with sureness, and the full bobbin can be prevented from being dropped from the receiving peg during when the receiving peg is being swivelled within a horizontal plane and tilted within a vertical plane while the full bobbin is being transferred from the receiving peg to another package storing apparatus such as a package truck.

A further object of the present invention is to provide a method by which a running yarn is released from a traverse guide mounted on a winding apparatus when the full package is completed. Applying this method to the running yarn, the released yarn is wound around a package of the full bobbin to form one or more bunch windings. Accordingly, the yarn end is secured onto the package by means of the bunch windings, and the unwound yarn end is surely wound around the package when the full bobbin is rotated around the rotating axis thereof.

The above-mentioned objects and other further objects as well as novel features of the present invention will become more fully apparent from the detailed description set forth below with reference to the accompanying drawings. It is to be understood, however, that the drawings are for the purpose of illustration only and are not intended to be a definition of the limits of the invention.

DETAILED DESCRIPTION OF THE INVENTION

Figure 1:
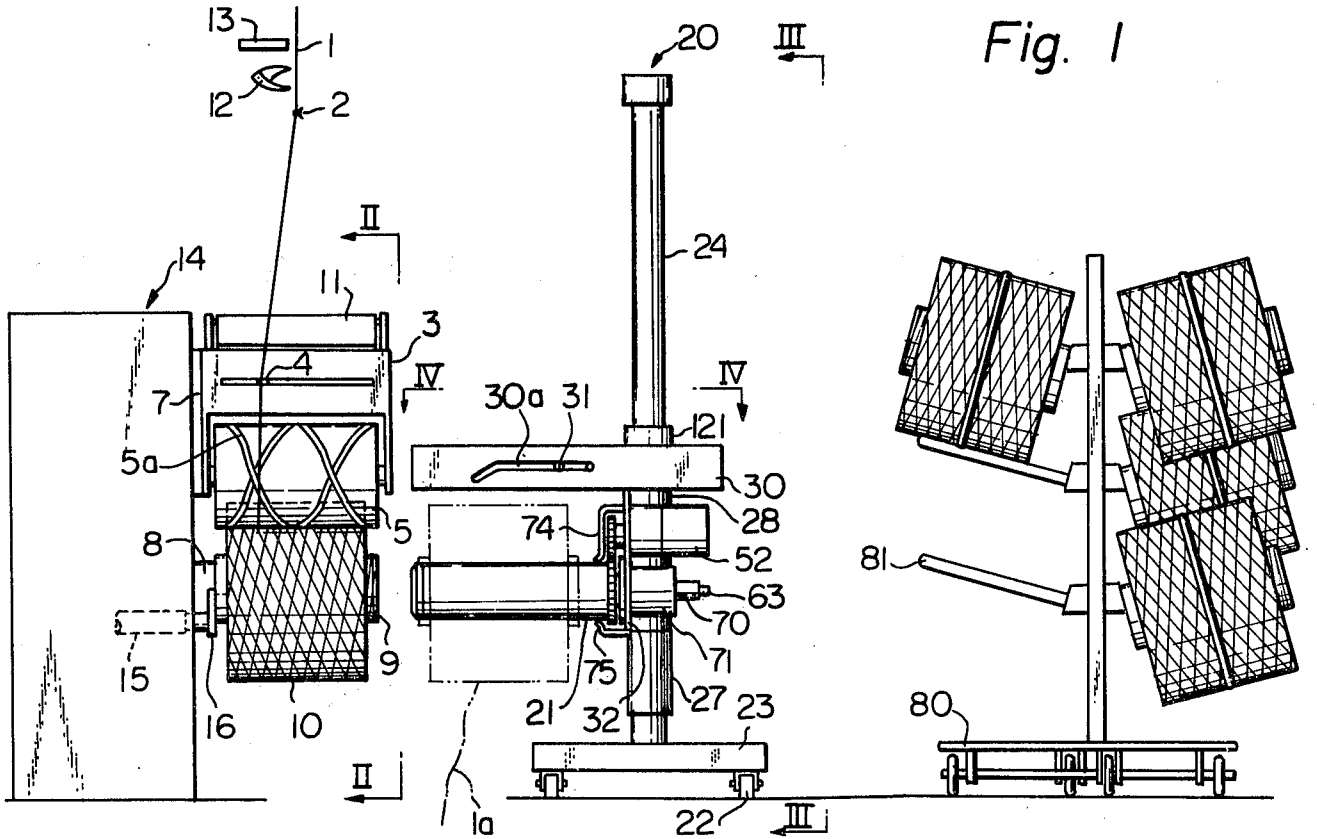
FIG. 1 is an elevational view of a bobbin-receiving apparatus according to the present invention and shows the bobbin-receiving apparatus being stopped in front of a winding apparatus and being accompanied by a package truck.
Figure 2:
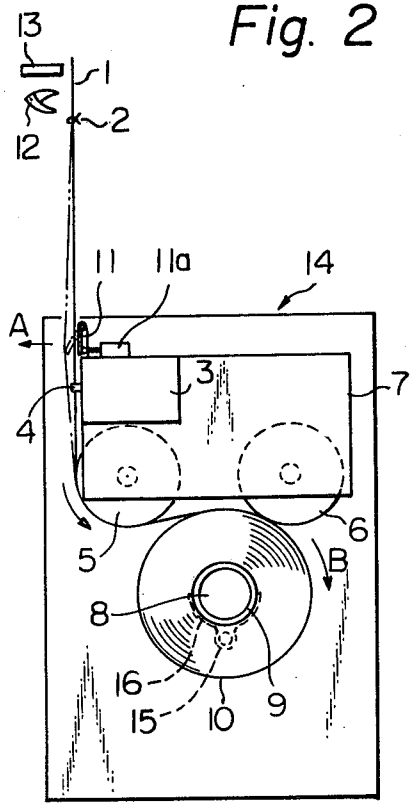
FIG. 2 is a side view taken in the direction of the arrow II—II shown in FIG. 1.

With reference to the accompanying FIGS. 1 and 2, a yarn 1 spun from a melt-spinning apparatus (not shown) is advanced through a yarn guide 2 and is traversed by a traverse guide 4 of a traverse device 3, which traverse guide 4 is reciprocated by a drum cam (not shown). Then the yarn 1 is engaged with a groove 5*a*, which is helically formed on the peripheral surface of a grooved roller 5, to ensure the traverse motion thereof. A friction roller 6 (in FIG. 2) is rotated at a constant speed via a driving motor (not shown). The traverse device 3, the grooved roller 5 and the friction roller 6 are all carried on a carrier 7 which is vertically slidable. A bobbin holder 8 holds a bobbin 9 thereon and is rotatably supported by a winding apparatus 14 for rotating around the axis thereof.

As the carrier 7 is displaced in the vertical direction, a predetermined contacting pressure is produced between the bobbin 9 held on the bobbin holder 8 and the friction roller 6. The bobbin 9 is rotated at a predetermined constant speed by the friction roller 6 and forms a package 10 around the bobbin 9.

Figure 11:
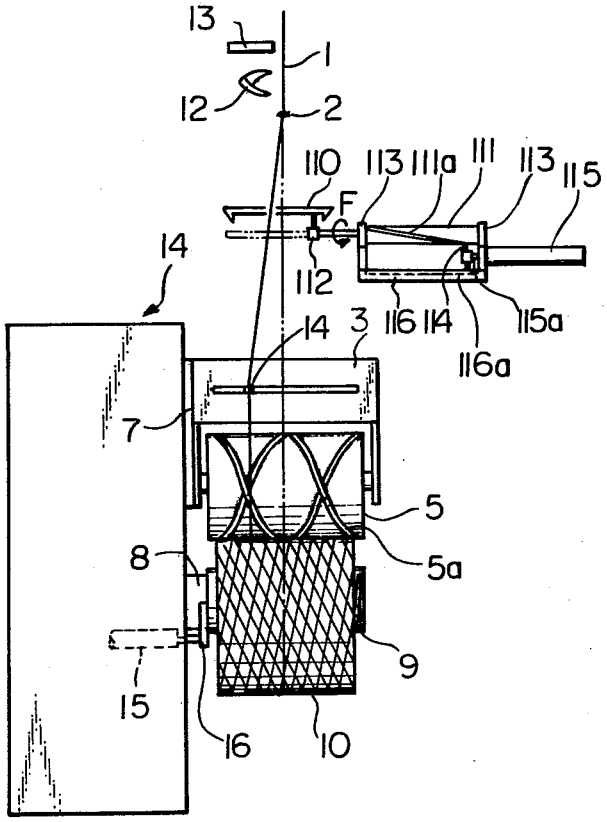
FIG. 11 is an elevational view of a yarn release guide mounted on a doffing apparatus.

When the amount of the package 10 formed on the bobbin 9 reaches a predetermined value, the yarn 1 running at a position upstream of the traverse guide 4 of the traverse device 3 is pushed and released from the traverse guide 4 by swinging a yarn release guide 11 in the direction of the arrow A in FIG. 2. The yarn release guide 11 is swingably mounted on the winding apparatus 14 and is swung by way of an air cylinder 11*a*. Another embodiment of a yarn release guide is illustrated in FIG. 11. Referring to FIG. 11, the yarn release guide 110 has a bar shape and is connected to an end of a cylindrical cam 111 via an arm 112. The cylindrical cam 111 is rotatably mounted via a pair of bearings 113 and has a helical groove 111*a* formed therearound. The helical groove 111*a* is engaged with a guide pin 114 which is fixed to a rod 115*a* of an air cylinder 115. The rod 115*a* is guide rectilinearly, without causing any rotation, by means of a straight guide groove 116*a* which is formed on a bracket 116 mounted on the doffing apparatus (not shown). When the air cylinder 115 is moved forward, the yarn release guide 110 moves toward the running yarn 1, turns around the axis of the cylindrical cam 111 in the direction of arrow F to a position shown by a dot-dash line and releases the yarn 1 from the traverse guide 4 of the traverse device 3.

The yarn 1 released from the traverse guide 4 runs from the yarn guide 2 along a vertical line toward the package 10 so that the yarn tension between the yarn guide 2 and the package 10 is maintained at minimum and forms bunch windings of about 10 turns around the package 10. Then the running yarn is cut by means of a cutting device 12 which is manually operated or which is mounted on a mechanically-operated doffing apparatus (not shown). Simultaneously, the cut yarn 1 is sucked by a sucking device 13 which is manually operated or which is mounted on the mechanically-operated doffing apparatus (not shown).

Thereafter, the bobbin holder 8 is decelerated rapidly by means of a brake device (not shown) and is brought to a complete standstill. During the time interval between when the yarn is cut and when the bobbin holder is stopped, a yarn end 1*a* (a dot-dash line in FIG. 1) having a certain length is caused to hang down from the full bobbin 9.

Before the bobbin holder 8 is brought to a complete standstill, a bobbin-receiving apparatus 20 moves in front of the winding apparatus 14 and stops at a predetermined position. The axis of a bobbin-receiving peg 21 is horizontally aligned with the axis of the bobbin holder 8 mounted on the winding apparatus 14. Then a push-out device 16, which is of a type described in Japanese Laid-open Publication No. 42867/76 and which is mounted on the winding apparatus 14, is advanced toward the full bobbin 9 by means of a push-out air cylinder 15 for pushing out the full bobbin 9 to the bobbin-receiving peg 21 mounted on the bobbin-receiving apparatus 20. After an empty bobbin 9' (see FIGS. 7 and 8) is inserted on the bobbin holder 8 by hand or by means of the mechanically-operated doffing apparatus (not shown), the yarn 1 being sucked by the sucking device 13 is threaded up on the empty bobbin 9' by hand or by means of the doffing apparatus (not shown).

The bobbin-receiving apparatus 20 according to the present invention is hereinafter explained in detail with reference to the accompanying FIGS. 1, 3 and 4. The bobbin-receiving apparatus 20 comprises a truck 23 which is movable in front of the winding apparatus 14 by means of wheels 22; a vertical post 24 projecting from the truck 23; a guide post 25 projecting from the truck 23 in parallel with the vertical post 24; a vertically movable head 27 which is guided by the vertical post 24 and the guide post 25; a swivel head 28 which is rotatably supported on the vertically movable head 27 via bearings (not shown) so as to swivel to an angle of 180 degrees; and the above-mentioned bobbin-receiving peg 21 which is rotatably mounted on the swivel head 28.

Figure 3:
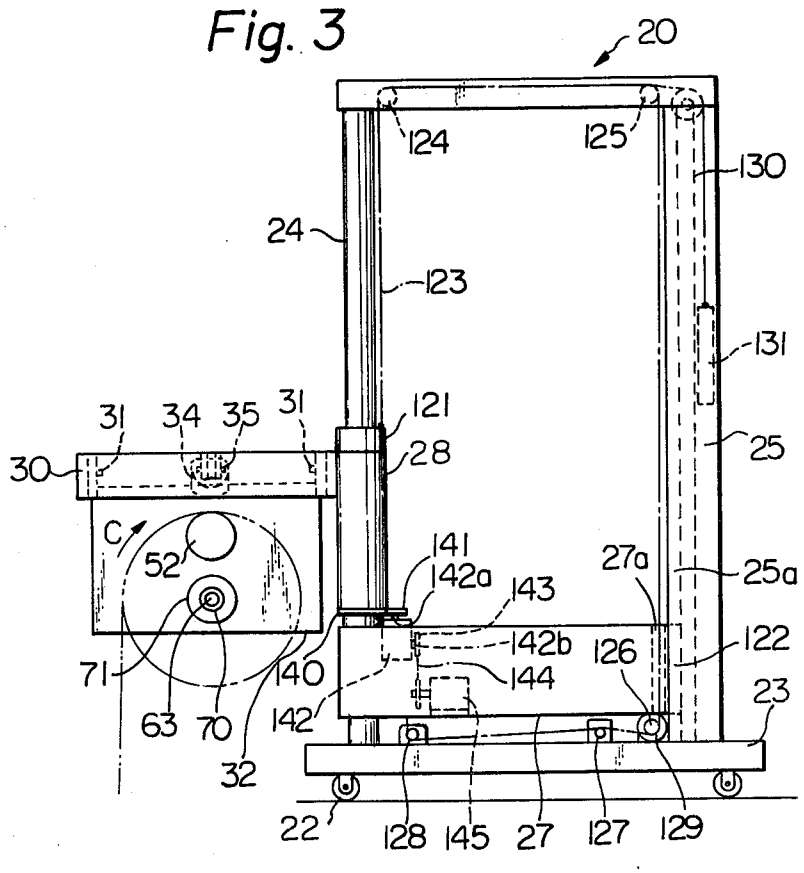
FIG. 3 is a side view taken in the direction of the arrow III—III shown in FIG. 1.

Referring to FIG. 3, one end of the vertically movable head 27 is provided with a slide bearing member 121. The slide bearing member 121 has a slide bearing (not shown) mounted therein for moving the vertically movable head 27 along the vertical post 24. The other end of the vertically movable head 27 is provided with a guide member 122 for moving the vertically movable head 27 along a groove 25*a* formed on the guide post 25. The upper portion of the slide bearing member 121 is connected to one end of chain 123. The vertically movable head 27 has a longitudinal hole 27*a* which permits the chain 123 to pass therethrough. The chain 123 are guided by sprockets 124, 125, 126, 127 and 128, each of the sprockets being rotatably mounted on the truck 23. The other end of the chain 123 is connected to the bottom portion of the vertically movable head 27, so that the chain 123 forms a loop. The sprocket 126 is connected to a motor 129 mounted on the truck 23. One end of another chain 130 is also connected to the upper portion of the slide bearing member 121, and the other end of the chain 130 is connected to a counterweight 131. Accordingly, when the motor 129 is rotated in a clockwise direction, the vertically movable head 27 is moved upward. On the other hand, when the motor 129 is rotated in a counterclockwise direction, the vertically movable head 27 is lowered.

As mentioned above, the swivel head 28 is rotatably supported on the vertically movable head 27 via bearings (not shown), and the lower end of the swivel head 28 is provided with a cogwheel 140 (FIG. 3), which comprises an annular disc (not shown) and chains (not shown) disposed around the disc (not shown). The cogwheel 140 is meshed with a sprocket 141 connected to an output shaft 142*a* of a reduction gear 142. An input shaft 142*b* of the reduction gear 142 is connected to a pulley 143 which is connected to a motor 145 mounted on the vertically movable head 27 via a belt 144. Accordingly, when the motor 145 is rotated, the swivel head 28 is swiveled around the vertical post 24.

Figure 4:
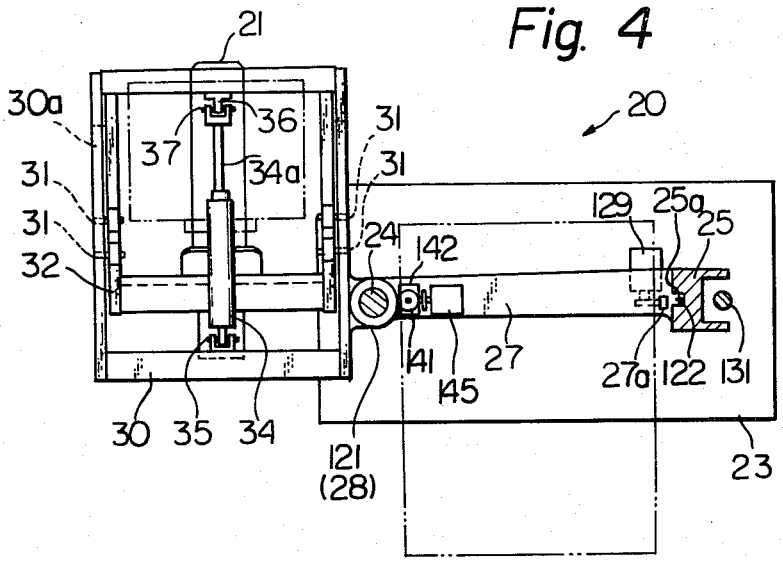
FIG. 4 is a plan view taken in the direction of the arrow IV—IV shown in FIG. 1.

Referring to FIG. 4, the swivel head 28 is provided with a rectangular-shaped frame 30 fixed to the swivel head 28. A base plate 32 having an L-shaped side view is movably and pivotably supported on the frame 30 by means of two pairs of cam followers 31 situated in the J-shaped grooves 30*a* formed on the frame 30 (FIG. 1). One end of an air cylinder 34 is pivotably supported on the frame 30 by means of a pin 35. The air cylinder 34 has a piston rod 34*a*, the top end of which is connected to a tip 36, fixed to the base plate 32, by a pin 37. Accordingly, when the piston rod 34*a* of the air cylinder 34 is moved forward, the base plate 32 moves along the grooves 30*a* and is tilted within a vertical plane.

The bobbin-receiving peg 21 is explained hereinafter with reference to the accompanying FIG. 5. A support 40 having a penetrating hole 40*a* therein is rigidly fixed to the base plate 32 and has a rotatable cylinder 42 rotatably mounted thereon via a pair of bearings 41. The bobbin-receiving peg 21 for receiving a full bobbin 9 is fixed to the rotatable cylinder 42. The rear end of the rotatable cylinder 42 is provided with a gear 51 which meshes with a driving gear 50. The driving gear 50 is driven via a motor 52 and a reduction gear 53 both mounted on the base plate 32. In the present invention, the rotational direction (shown by arrow C in FIG. 3) of the bobbin-receiving peg 21 by means of the motor 52 is selected to be the same as the rotational direction (shown by arrow B in FIG. 2) of the bobbin holder 8 mounted on the winding apparatus 14. The rotational speed of the bobbin-receiving peg 21 is selected to be sufficiently low so that the yarn end 1*a* hanging down from the full bobbin held on the receiving peg 21 can be wound back. The base plate 32 is further provided with covers 74 and 75 for covering the gears 50 and 51.

Discs 61 and 62 having holes 61*a* and 62*a*, respectively are fixed inside the front end position of the bobbin-receiving peg 21 and at a position adjacent to one of the bearings 41. A rod 63 is inserted into the holes 61*a* and 62*a* of the discs 61 and 62 and into the penetrating hole 40*a* of the support 40. A bearing member 64 is fixed on the front end of the rod 63, and the member 64 is slidably supported by a slide bearing 65 mounted on the disc 61. A compression spring 66 is provided at a position between the rear end of a sliding member 69 slidably mounted on the rod 63 and the disc 62 for urging the rod 63 via the sliding member 69 and the bearing member 64. The outer end of the rod 63 is provided with a photo-electric device 72, which faces to the bobbin holder (FIG. 2) through a hole 73*a* formed on a cap 73, for detecting the stoppage of the bobbin holder (FIG. 2).

The pair of discs 61 and 62 is connected together with a pair of parallel plates 67. An L-shaped hook 68 (as illustrated in FIG. 5) is pivotably mounted on the parallel plates 67 by means of a pin 68*a*. The hook 68 is also shaped into Y-shaped branches (as illustrated in FIG. 6), and such branches are connected together with a pin 68*a*. The pin 68*a* is engaged into a U-shaped slit 69*a* (FIG. 5) which is formed on the sliding member 69. Accordingly, when the rod 63 is moved forward by means of the compression spring 66, the hook 68 turns the pin 68*a* around the pin 68*b* due to the cooperation of the U-shaped slit 69*a* and the pin 68*a*, then the front end of the hook 68 is projected from a longitudinal slit 21*a* formed on the bobbin-receiving peg 21. It is preferable to attach a durable material (not shown) having a high friction coefficient, such as rubber, to the front end of the hook 68.

Figure 5:
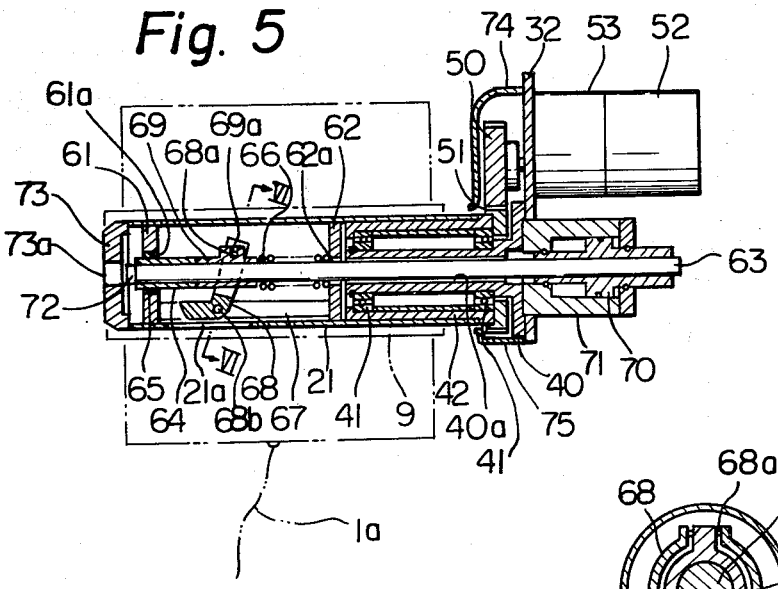
FIG. 5 is a partially enlarged cross-sectional view of a receiving peg mounted on the bobbin-receiving apparatus shown in FIG. 1.
Figure 6:
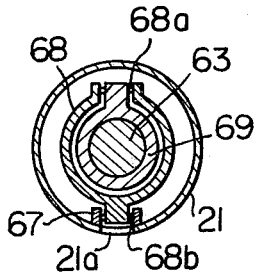
FIG. 6 is a side view taken in the direction of the arrow VI—VI shown in FIG. 5.

The base plate 32, as shown in FIG. 5, is also provided with an air cylinder 71 which has a piston 70 mounted slidably within the cylinder 71. The piston 70 is rigidly fixed to the rod 63. Accordingly, when the rod 63 is reciprocated by means of the air cylinder 71, the hook 68 is moved out from the bobbin-receiving peg 21 by means of the compression spring 66.

With reference to FIG. 5, the rod 63 is reversed by means of the air cylinder 71 and the hook enters into the bobbin-receiving peg 21; then, a full bobbin 9 is doffed from the winding apparatus 14 (shown in FIG. 1) to the bobbin-receiving peg 21. Thereafter, as the rod 63 is moved forward, the hook 68 exits from the bobbin-receiving peg 21 by means of the compression spring 66 and provides for the frictional engagement between the bobbin-receiving peg 21 and the full bobbin 9. The bobbin-receiving peg 21 is rotated with the full bobbin 9 at a predetermined low speed in a direction which is the same as the rotational direction of the bobbin holder 8 mounted on the winding apparatus 14. The yarn end 1*a* hanging down from the full bobbin 9 is fully wound back around the full bobbin 9. Therefore, the above-mentioned troubles caused by the yarn end hanging down from the full bobbin are fully prevented. While the bobbin-receiving peg 21 is being rotated, the rod 63 does not rotate. Therefore, the electric lead line (not shown) connected to the photo-electric device 72 and formed within the rod 63 cannot prevent the peg 21 from rotating.

Figure 7:
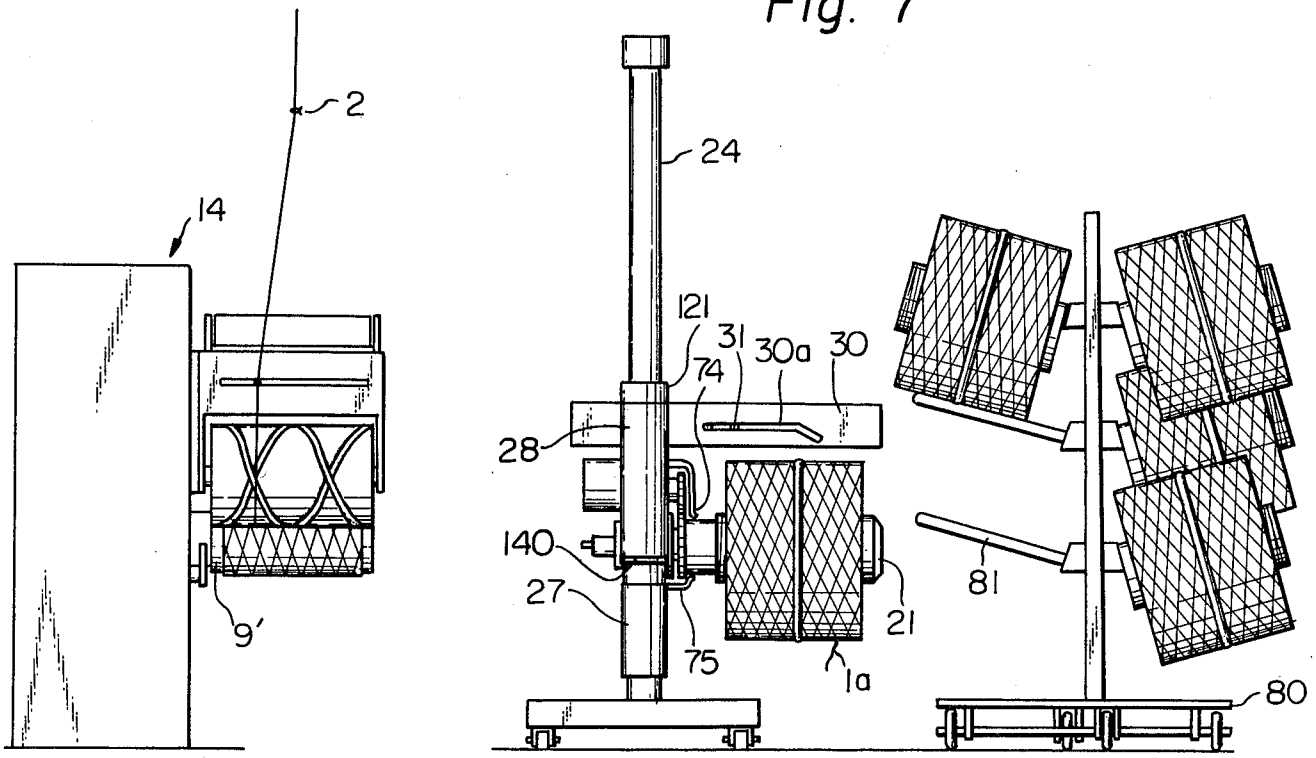
FIGS. 7 and 8 are elevational views which respectively illustrate the operation of the bobbin-receiving apparatus shown in FIG. 1.
Figure 8:
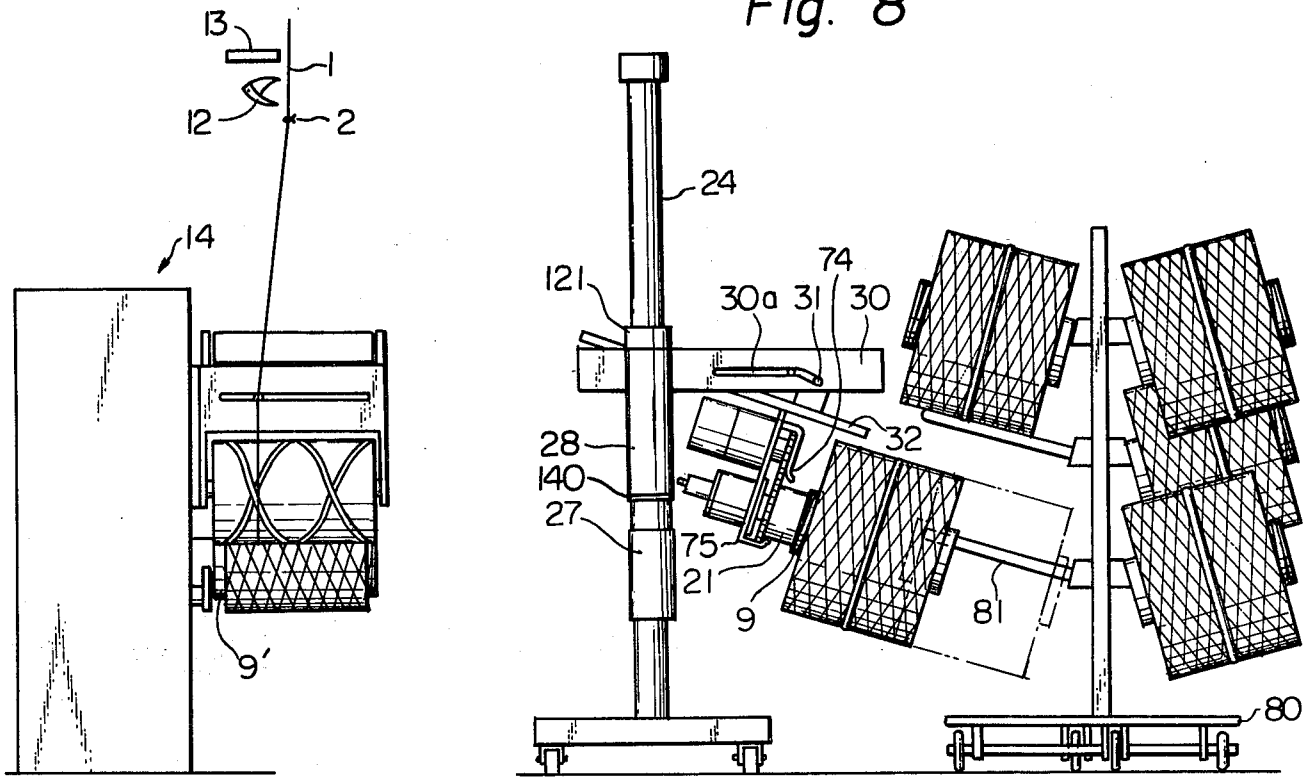

According to FIG. 7, the receiving peg 21 is swiveled around the vertical post 24 to face a peg 81 mounted on a package truck 80. Then the receiving peg 21 is lifted or lowered by means of the vertically movable head 27 in correspondence with the height of the peg 81 mounted on the package truck 80. The receiving peg 21 is tilted downward (see FIG. 8) by means of the air cylinder 34 (FIGS. 3 and 4). In FIG. 5, as the piston 70 mounted in the air cylinder 71 is reversed and as the hook 68 enters into the bobbin-receiving peg 21, the frictional engagement between the bobbin-receiving peg 21 and the full bobbin 9 is released. Accordingly, the full bobbin 9 is transferred from the bobbin-receiving peg 21 to the peg 81 (FIG. 8) mounted on the package truck 80 (FIG. 8). In this case, referring to FIG. 8 a push-out device (not shown) having a construction similar the push-out device 16 (FIG. 1) mounted on the winding apparatus 14 (FIG. 1) may be provided on the bobbin-receiving apparatus 20 for pushing out the full bobbin 9 mounted on the bobbin-receiving peg 21 to the peg 81 mounted on the package truck 80.

A device for frictionally engaging the bobbin-receiving peg and the full bobbin according to the present invention is, of course, not limited to the device described in the embodiment. A device comprising a cylinder with slits and a pair of tapered members for expanding the cylinder, which is utilized as a bobbin-holding device in a bobbin holder, may be used as a device for effecting frictional engagement.

Figure 10:
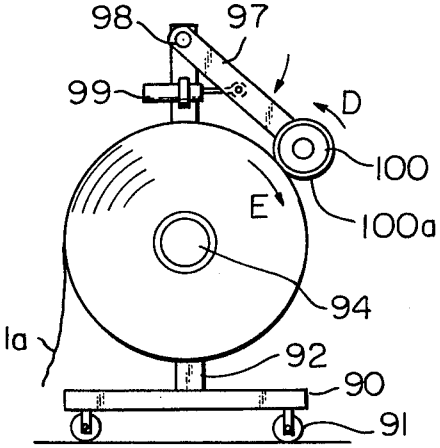
FIG. 10 is a side view of the second embodiment shown in FIG. 8.

The second embodiment according to the present invention is explained hereinafter with reference to the accompanying FIGS. 9 and 10. In the figures, a truck 90 movable with wheels 91 is provided with a vertical post 92 which has a bracket 93. The bracket 93 has a bobbin-receiving peg 94 rotatably mounted therein via a pair of bearings 95 and 96. The vertical post 92 also has a lever 97 pivotably mounted thereon via a pin 98. The lever 97 is connected to an urging member which comprises an air cylinder 99. The front end of the lever has a roller 100 having a rubber coating 100*a* pivotably mounted thereon. The roller 100 is connected to a motor 101 via a reduction gear 102.

The full bobbin 9 held on the bobbin-receiving peg 94 is urged by the roller 100 which is actuated by the air cylinder 99.

The roller 100 is then rotated in the direction of the arrow D (in FIG. 10) by means of the motor 101 and rotates the full bobbin 9 in the direction of the arrow E (in FIG. 10) which is the same as the rotational direction of the bobbin holder 8 mounted on the winding apparatus 14 (see FIG. 2). A yarn end hanging down from the full bobbin 9 is wound back around the full bobbin 9. Accordingly, the above-mentioned problems caused by the yarn end are fully prevented from occurring.

Figure 9:
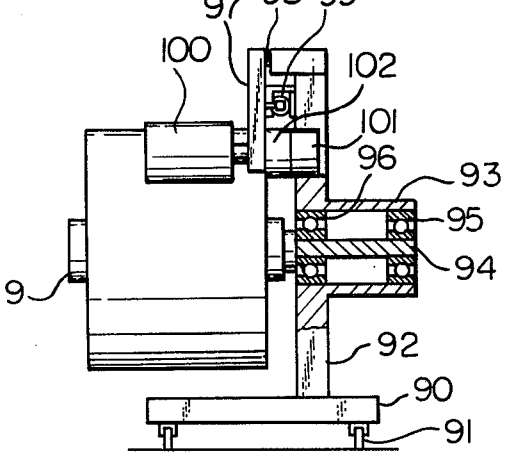
FIG. 9 is an elevational view of the second embodiment according to the present invention.

The embodiment shown in FIGS. 8 and 9 may also be constructed in a manner similar to that of the above-mentioned first embodiment, so that the bobbin-receiving peg 94 can move vertically along the vertical post 92, swivel around the vertical post 92 or tilt within a vertical plane.

What we claim is:

1. A method for doffing a full bobbin which comprises winding a full bobbin by way of a winding apparatus comprising a rotatable bobbin-holding means for holding a bobbin on which a yarn is wound to form a package and a traverse means for traversing said yarn along said bobbin, cutting said yarn extending toward said full bobbin, and doffing said full bobbin from said winding apparatus to a bobbin receiving apparatus, wherein said method is characterized by:

a first step of doffing said full bobbin from said bobbin holding means mounted on said winding apparatus to a bobbin-receiving peg mounted on said bobbin-receiving apparatus; and a second step of rotating said bobbin-receiving peg and said full bobbin around the axis of said bobbin-receiving peg in the same direction as the rotational direction of said bobbin-holding means mounted on said winding apparatus, whereby a yarn end hanging down from said full bobbin is wound back around said full bobbin.

2. A method for doffing a full bobbin which comprises winding a full bobbin by way of a winding apparatus comprising a rotatable bobbin-holding means for holding a bobbin on which a yarn is wound to form a package and a traverse means for traversing said yarn along said bobbin, cutting said yarn extending toward said full bobbin, and doffing said full bobbin from said winding apparatus to a bobbin-receiving apparatus, wherein said method is characterized by:

a first step of releasing said yarn from said traverse means and forming at least one bunch wind around said package formed around said bobbin, said first step taking place between the completion of winding said full bobbin and cutting said yarn;

a second step of doffing said full bobbin from said bobbin-holding means mounted on said winding apparatus to a bobbin-receiving peg mounted on said bobbin-receiving apparatus; and a third step of rotating said full bobbin around the axis of said bobbin-receiving peg in the same direction as the rotational direction of said bobbin-holding means mounted on said winding apparatus, whereby a yarn end hanging down from said full bobbin is wound back around said full bobbin.

3. A method for doffing a full bobbin according to claim 1, wherein said rotation of said full bobbin around said axis of said bobbin-receiving peg is caused by mechanically rotating said bobbin-receiving peg.

4. A method for doffing a full bobbin according to claim 3, wherein said full bobbin is frictionally engaged by said bobbin-receiving peg, whereby said rotation of said full bobbin is ensured.

5. A method for doffing a full bobbin which comprises winding a full bobbin by way of a winding apparatus comprising a rotatable bobbin-holding means for holding a bobbin on which a yarn is wound to form a package and a traverse means for traversing said yarn along said bobbin, cutting said yarn extending toward said full bobbin, and doffing said full bobbin from said winding apparatus to a bobbin-receiving apparatus, wherein said method is characterized by:

releasing said yarn from said traverse means and forming at least one bunch wind around said package formed around said bobbin between the completion of winding said full bobbin and cutting said yarn;

aligning the axis of a bobbin-receiving peg mounted on said bobbin-receiving apparatus with that of said bobbin-holding means;

doffing said full bobbin from said bobbin-holding means mounted on said winding apparatus to said bobbin-receiving peg mounted on said bobbin-receiving apparatus; and rotating said full bobbin around said axis of said bobbin-receiving peg in the same direction as the rotational direction of said bobbin-holding means mounted on said winding apparatus at a speed not exceeding a predetermined speed so that a yarn end hanging down from said full bobbin can be wound back around said full bobbin.

6. A method for doffing a full bobbin which comprises winding a full bobbin by way of a winding apparatus comprising a rotatable bobbin-holding means for holding a bobbin on which a yarn is wound to form a package and a traverse means for traversing said yarn along said bobbin, cutting said yarn extending toward said full bobbin, and doffing said full bobbin from said winding apparatus to a bobbin-receiving apparatus, wherein said method is characterized by:

releasing said yarn from said traverse means and forming at least one bunch wind around said package formed around said bobbin between the completion of winding said full bobbin and cutting said yarn;

aligning the axis of a bobbin-receiving peg mounted on said bobbin-receiving apparatus with the axis of said bobbin-holding means;

doffing said full bobbin from said bobbin-holding means mounted on said winding apparatus to said bobbin-receiving peg mounted on said bobbin-receiving apparatus; and rotating said bobbin-receiving peg around the axis thereof in the same direction as the rotational direction of said bobbin-holding means mounted on said winding apparatus, whereby a yarn end hanging down from said full bobbin is wound back around said full bobbin.

7. A method for doffing a full bobbin which comprises winding a full bobbin by way of a winding apparatus comprising a rotatable and horizontal bobbin-holding means for holding a bobbin on which a yarn is wound to form a package and a traverse means for traversing said yarn along said bobbin, cutting said yarn extending toward said full bobbin, and doffing said full bobbin from said winding apparatus to a bobbin-receiving apparatus, wherein said method is characterized by:

releasing said yarn from said traverse means and forming at least one bunch wind around said package formed around said bobbin between the completion of winding said full bobbin and cutting said yarn;

aligning the axis of a bobbin-receiving peg mounted on said bobbin-receiving apparatus with the axis of said bobbin-holding means;

displacing said full bobbin from said bobbin-holding means mounted on said winding apparatus to said bobbin-receiving peg mounted on said bobbin-receiving apparatus;

frictionally engaging said receiving peg with said full bobbin held on said receiving peg; and rotating said bobbin-receiving peg around the axis thereof in the same direction as the rotational direction of said bobbin-holding means mounted on said winding apparatus, whereby a yarn end hanging down from said full bobbin is wound back around said full bobbin.

8. A method for doffing a full bobbin which comprises winding a full bobbin by way of a winding apparatus comprising a rotatable and horizontal bobbin-holding means for holding a bobbin on which a yarn is wound to form a package and a traverse means for traversing said yarn along said bobbin; cutting said yarn extending toward said full bobbin; and doffing said full bobbin form said winding apparatus to a bobbin-receiving apparatus, wherein said method is characterized by:

a first step of releasing said yarn from said traverse menas and forming a bunch wind around said package formed around said bobbin;

a second step of cutting said yarn running toward said bunch wind;

a third step of aligning the axis of a bobbin-receiving peg mounted on said bobbin-receiving apparatus with the axis of said bobbin-holding means;

a fourth step of doffing said full bobbin from said bobbin-holding means to said bobbin-receiving peg; and a fifth step of rotating said full bobbin around the axis of said bobbin-receiving peg in the same direction as the rotational direction of said bobbin-holding means mounted on said winding apparatus, whereby a yarn end hanging down from said full bobbin is wound back around said bobbin.

9. A method for doffing a full bobbin which comprises winding a full bobbin by way of a winding apparatus comprising a rotatable and horizontal bobbin-holding means for holding a bobbin on which a yarn is wound to form a package and a traverse means for traversing said yarn along said bobbin, cutting said yarn extending toward said full bobbin, and doffing said full bobbin from said winding apparatus to a bobbin-receiving apparatus, wherein said method is characterized by:

a first step of releasing said yarn from said traverse means when said full bobbin is completed and forming a bunch wind around said package formed around said bobbin;

a second step of cutting said yarn running toward said bunch wind;

a third step of aligning the axis of a bobbin-receiving peg mounted on said bobbin-receiving apparatus with the axis of said bobbin-holding means;

a fourth step of displacing said full bobbin from said bobbin-holding means to said bobbin-receiving peg;

a fifth step of frictionally engaging said receiving peg with said full bobbin held on said receiving peg; and a sixth step of rotating said bobbin-receiving peg around the axis thereof in the same direction as the rotational direction of said bobbin-holding means mounted on said winding apparatus, whereby a yarn end hanging down from said full bobbin is wound back around said full bobbin.

10. An apparatus for receiving a full bobbin from a winding apparatus comprising a horizontal and rotatable bobbin-holding means for holding a bobbin on which a yarn is wound to form a package, said receiving apparatus comprising a truck movable in front of said winding apparatus and a horizontal peg mounted on said truck for receiving said full bobbin from said bobbin-holding means, the improvement wherein said receiving apparatus further comprises:

a means for supporting said bobbin-receiving peg for rotation about the axis of the peg; and a means for rotating said bobbin-receiving peg and a full bobbin held on said bobbin-receiving peg in the same direction as the rotational direction of said bobbin-holding means mounted on said winding apparatus, whereby a yarn end hanging down from said full bobbin doffed from said winding apparatus to said bobbin-receiving apparatus is wound back around said full bobbin.

11. An apparatus for receiving a full bobbin from a winding apparatus comprising a horizontal and rotatable bobbin-holding means for holding a bobbin on which a yarn is wound to form a package, said receiving apparatus comprising a truck movable in front of said winding apparatus and a horizontal peg mounted on said truck for receiving said full bobbin from said bobbin-holding means, the improvement wherein said receiving apparatus further comprises:

a means for supporting said bobbin-receiving peg for rotation about the axis of the peg;

a means for rotating said bobbin-receiving peg and a full bobbin held on said bobbin-receiving peg in the same direction as the rotational direction of said bobbin-holding means mounted on said winding apparatus; and a transmitting means for connecting said bobbin rotating means to said bobbin-receiving peg, whereby a yarn end hanging down from said full bobbin doffed from said winding apparatus to said bobbin-receiving apparatus is wound back around said full bobbin.

12. An apparatus for receiving a full bobbin according to claim 11, wherein said transmitting means comprises a gear mounted on said bobbin-receiving peg and a gear meshing with said gear and mounted on said bobbin-rotating means.

13. An apparatus for receiving a full bobbin according to claim 12 wherein said-receiving peg is rotatably supported by a stationary shaft.

14. An apparatus for receiving a full bobbin according to claim 11, which further comprises a means for frictionally engaging said full bobbin with said bobbin-receiving peg so that said full bobbin is ensured the rotation thereof by rotating said bobbin-receiving peg.

15. An apparatus for receiving a full bobbin from a winding apparatus comprising a horizontal and rotatable bobbin-holding means for holding a bobbin on which a yarn is wound to form a package, said receiving apparatus comprising a truck movable in front of said winding apparatus and a horizontal peg mounted on said truck for receiving said full bobbin from said bobbin-holding means, the improvement wherein said receiving apparatus further comprises:

a means for supporting said bobbin-receiving peg for rotation about the axis of the peg; and a means for rotating a full bobbin held on said bobbin-receiving peg in the same direction as the rotational direction of said bobbin-holding means mounted on said winding apparatus, said bobbin-rotating means comprising a driving roller which is urged toward the outer surface of said full bobbin held on said bobbin-receiving peg and which frictionally rotates said full bobbin, whereby a yarn end hanging down from said full bobbin doffed from said winding apparatus to said bobbin-receiving apparatus is wound back around said full bobbin.

16. An apparatus for receiving a full bobbin from a winding apparatus comprising a horizontal and rotatable bobbin-holding means for holding a bobbin on which a yarn is wound to form a package, said receiving apparatus comprising a truck movable in front of said winding apparatus and a horizontal peg mounted on said truck for receiving said full bobbin from said bobbin-holding means, wherein said receiving apparatus further comprises:

a means for supporting said bobbin-receiving peg for rotation about the axis of the peg a means for rotating said rotatable bobbin-receiving peg in the same direction as the rotational direction of said bobbin-holding means mounted on said winding apparatus;

a transmitting means for connecting said bobbin rotating means to said bobbin-receiving peg;

a vertical post projecting from said truck; and a means for vertically displacing said bobbin-receiving peg, said bobbin-rotating means and said transmitting means along said vertical post; whereby the axis of said bobbin-receiving peg is aligned with the axis of said bobbin-holding means mounted on said winding apparatus, said full bobbin is displaced from said bobbin-holding means to said bobbin-receiving peg, and said full bobbin is rotated around the axis thereof for winding a hanging yarn end back therearound.

17. An apparatus for receiving a full bobbin according to claim 16, which further comprises a means for tilting said bobbin-receiving peg within a vertical plane which includes the axis of said bobbin-receiving peg.

18. An apparatus for receiving a full bobbin according to claim 16, which further comprises a means for swiveling said bobbin-receiving peg around said vertical post.

19. An apparatus for receiving a full bobbin from a winding apparatus comprising a horizontal and rotatable bobbin-holding means for holding a bobbin on which a yarn is wound to form a package, said receiving apparatus comprising a truck movable in front of said winding apparatus and a horizontal peg mounted on said truck for receiving said full bobbin from said bobbin-holding means, wherein said receiving apparatus further comprises:

a means for supporting said bobbin-receiving peg for rotation about the axis of the peg a means for securing said bobbin-receiving peg attachable to and detachable from said full bobbin, said securing means provided within said bobbin-receivinhg peg;

a means for rotating said rotatable bobbin-receiving peg in the same direction as the rotational direction of said bobbin-holding means;

a transmitting means for connecting said bobbin-rotating means to said bobbin-receiving peg;

a vertical post projecting from said truck;

a means for vertically displacing and swiveling said bobbin-receiving peg, said bobbin rotating means and said transmitting means along said vertical post; and a means for tilting said bobbin-receiving peg within a vertical plane which includes the axis of said bobbin-receiving peg.

* * * * *

UNITED STATES PATENT AND TRADEMARK OFFICE

CERTIFICATE OF CORRECTION

PATENT NO. : 4,138,072

DATED : February 6, 1979

INVENTOR(S) : Hideki Aoyama, et al.

It is certified that error appears in the above-identified patent and that said Letters Patent are hereby corrected as shown below:

In the Claims:

Claim 8, column 10, line 59, correct spelling of "from".

Claim 8, column 10, line 62, correct spelling of "means".

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*